United States Patent [19]

Ives

[11] 4,079,660

[45] Mar. 21, 1978

[54] SAFETY VALVE FOR PISTON TYPE PNEUMATIC POWERED MOTOR

[76] Inventor: Frank E. Ives, 2402 M St. NE., Auburn, Wash. 98002

[21] Appl. No.: 702,065

[22] Filed: Jul. 2, 1976

[51] Int. Cl.[2] ..... F01L 31/08; F01L 23/00

[52] U.S. Cl. ..... 91/337; 91/342; 91/450; 91/453; 251/297; 137/625.68; 137/625.69

[58] Field of Search ..... 91/342, 337, 450; 251/297

[56] References Cited

U.S. PATENT DOCUMENTS

| | | | |
|---|---|---|---|
| 2,617,257 | 11/1952 | Douglas | 251/297 |
| 2,758,569 | 8/1956 | Peterson | 91/342 |
| 3,274,899 | 9/1966 | Stump | 91/342 |
| 3,602,245 | 8/1971 | Meisel | 251/297 |

*Primary Examiner*—Paul E. Maslousky
*Attorney, Agent, or Firm*—Christensen, O'Connor, Johnson & Kindness

[57] ABSTRACT

A piston type, pneumatically powered motor includes a valve assembly for reversibly supplying pneumatic fluid to opposite sides of a piston to reciprocate the piston through power strokes in both directions. The valve assembly has a spool reciprocably mounted in a sleeve that normally moves between two positions to reversibly supply pneumatic fluid to the piston. An actuating mechanism shifts the valve spool between its two normal positions responsive to movement of the piston near the end of each power stroke. When the reciprocation rate of the piston reaches a predetermined high or excessive rate, the actuating mechanism shifts the valve spool to a third position that short circuits the normal path of the pneumatic fluid flowing to the piston and channels the pneumatic fluid to an exhaust port.

12 Claims, 4 Drawing Figures

SAFETY VALVE FOR PISTON TYPE PNEUMATIC POWERED MOTOR

BACKGROUND OF THE INVENTION

The present invention relates to piston type, fluid powered motors, especially pneumatically powered motors that have a reversing valve mechanism for reversibly supplying pneumatic fluid to the piston, and more particularly to a safety mechanism associated with the reversing valve for stopping the motor when its reciprocation rate exceeds a predetermined maximum.

Pneumatically powered motors are used for a variety of prime moving tasks, for example, for powering a pump for pumping viscous resin mixtures from a reservoir or holding tank to a mold where the resin is polymerized to form a desired article. Such pneumatically powered motors are normally of the piston and cylinder type employing a pneumatic fluid such as pressurized air to reciprocate the piston, which is coupled to the resin pump. These motors normally incorporate a valve mechanism for reversing the flow of pneumatic fluid to the cylinder from one side of the piston to the other, while exhausting fluid from the cylinder on the opposite side of the piston. When the pump or other apparatus to which the drive piston is connected is under a load, for example when the pump is pumping a resin, the piston will reciprocate at a predetermined rate dependent upon, among other parameters, the pressure of the pneumatic fluid and the viscosity of the material being pumped. If however, the fluid pressure driving the piston should accidentally be increased or if the load is removed from the pump, the piston reciprocation rate will increase dramatically. Although such pumps and their associated piston type motors are generally built to withstand very high reciprocation rates and the concomitant vibration, the very high reciprocation rate can create an apprehension in the operator that the motor may catastrophically disintegrate.

In any event, the motor must be slowed down or stopped before it runs at a high reciprocation rate for a long period of time to prevent undue wear on the motor and pump components, to relieve the operator's apprehension of harm, and to allow time to replenish the supply of fluid in the pump reservoir. Prior art techniques for shutting down the motor have ranged from simply manually closing the pneumatic fluid supply line to the motor to an automatic shut-off valve in the fluid supply line that is responsive to high fluid flow accompanying high reciprocation rates. Manually blocking the supply of pneumatic fluid to the pneumatically powered motor has been a satisfactory solution but requires time to effect, during which the motor continues to reciprocate at an excessive rate, normally requires extra valve controls, increasing the expense, and normally requires such controls to be placed near the motor, potentially increasing an operator's apprehension of harm when he must shut down the motor. Interposing a flow responsive automatic shut-off valve in the pneumatic supply line has also been a satisfactory solution in the past. However, flow responsive shut-off valves are expensive, require constant adjustment, and are very sensitive to foreign matter present in the pneumatic fluid.

Accordingly, it is a broad object of the present invention to provide a mechanism associated with the pneumatic fluid supply system for a piston type motor to shut down the pneumatic motor when its reciprocation rate exceeds a predetermined maximum. More specific objects of the present invention are to provide a mechanism that does not require manual intervention to initiate the shut down process when the motor reciprocation rate reaches or exceeds a predetermined maximum; to provide a mechanism that will operate under all high reciprocation rate conditions; to provide a mechanism that will operate almost immediately upon occurrence of excessive motor reciprocation rate; to provide a mechanism that can easily be re-set so that motor operation can be resumed as soon as possible after the cause for the high reciprocation rate has been remedied; to provide a mechanism that requires little or no additional valving or other auxiliary assemblies to achieve the foregoing objects; to provide a mechanism that can be easily integrated into existing pneumatically powered motors; and to provide a mechanism that is easily and inexpensively manufactured and that requires little, and preferably no, additional maintenance.

SUMMARY OF THE INVENTION

In accordance with the foregoing objects, and other objects that will become apparent to one of ordinary skill in the art after reading the following specification, the present invention provides an improved safety valve mechanism for short circuiting the fluid supply to a piston reciprocated by the fluid when its reciprocation rate exceeds a predetermined maximum. In the preferred embodiment, the safety valve mechanism forms a part of and is integrated into the structure of a pneumatic fluid reversing valve. In its broad aspects, the valve of the present invention normally reciprocates between first and second positions to reverse the flow of pneumatic fluid to the piston responsive to movement of the piston at or near the end of its power strokes. A detent means is associated with the valve for releasably holding the valve in its first and second positions until it is shifted reponsive to piston movement. The valve of the present invention is further movable from one of the first or second positions to a third position wherein the valve short circuits the pneumatic fluid supply from the motor to an exhaust port, thus relieving all pneumatic fluid pressure within the assembly. The detent means is employed to hold the valve in its third position until the valve can be reset into one of its first and second positions to resume normal operation. In a preferred embodiment, a means for manually resetting the valve to its first or second position is provided.

More specifically, the present invention provides a fluid flow reversing valve assembly comprising a body means defining a valve bore and a valve spool reciprocally mounted in the valve bore for movement between first, second and third axially spaced positions. The body means further defines a plurality of ports in the valve bore including first and second outlet and inlet ports normally coupled to the cylinder carrying the fluid powered piston, a supply port for supplying fluid to the valve, and an exhaust port for exhausting fluid from the valve. The valve spool has first and second lands spaced axially along its outer surface that cooperate with the ports in the body means (a) when the valve spool is in the first position, to direct fluid from the supply port to the first outlet and inlet port and to direct fluid from the second outlet and inlet port to the exhaust port, (b) when the valve is in the second position, to direct fluid from the supply port to the second outlet and inlet port and to direct fluid from the first outlet and inlet port to the exhaust port, and (c) when the valve is in the third position to direct fluid from the supply port directly to the exhaust port without creating a driving pressure on the piston. A single detent means cooperates with a plurality of grooves on the valve spool to releasably hold the valve in its first, second and third positions. The advantages of the preferred embodiment of the present invention can readily be seen in that a conventional valve spool can be modified to cooperate with conventional detent means to hold the valve spool in its third, short circuiting position. No additional valve structure and no manual or other operator intervention are necessary to initiate operation of the safety valve mechanism.

BRIEF DESCRIPTION OF THE DRAWINGS

A better understanding of the present invention can be derived by reading the ensuing specification in conjunction with the accompanying drawings wherein.

DETAILED DESCRIPTION

Figure 1:
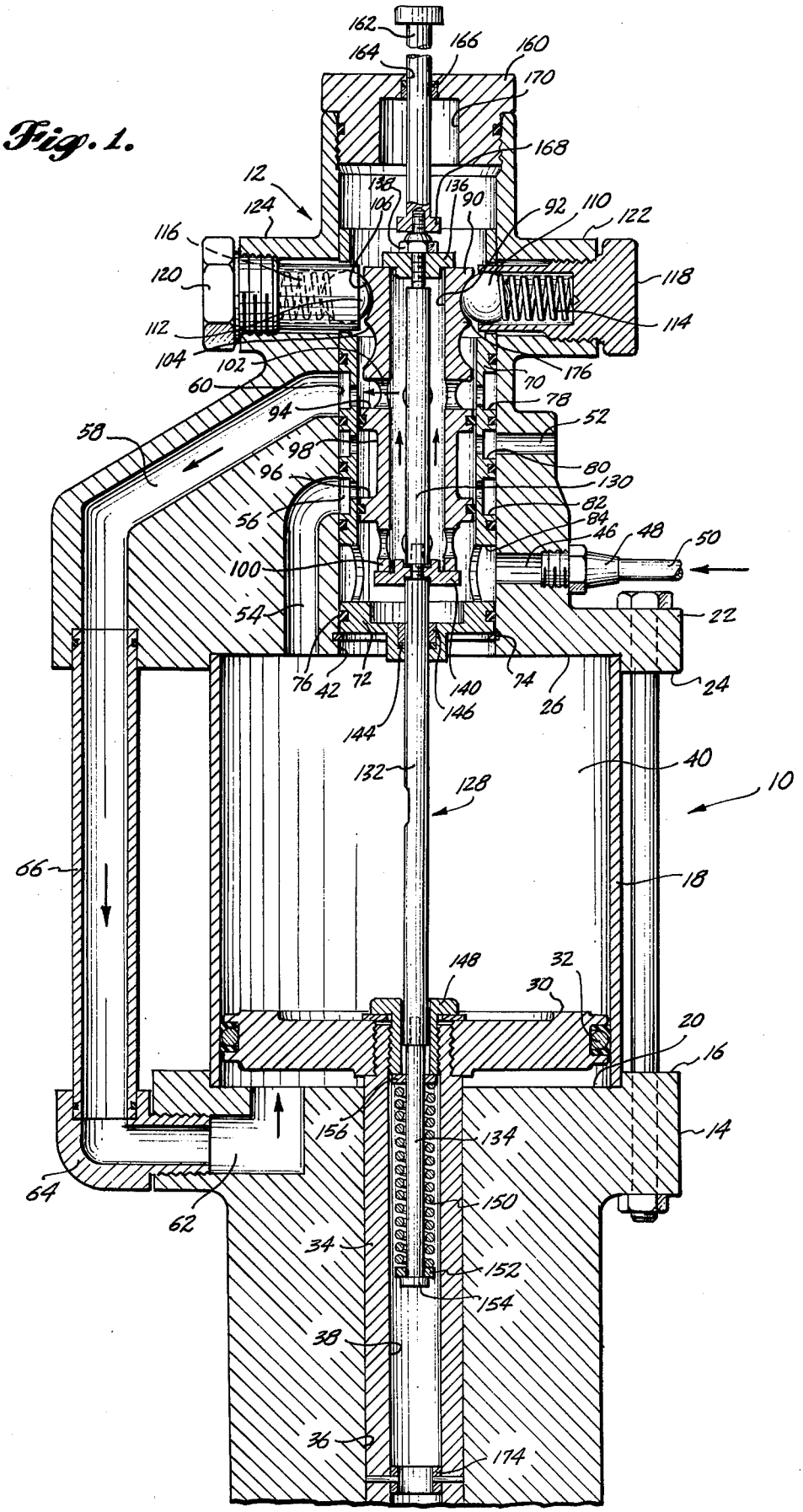
FIG. 1 is a longitudinal, sectional view of a piston type, pneumatically powered motor employing the reversing valve of the present invention and showing the valve in the first of its normal operating positions.

Referring to FIG. 1, a piston type, pneumatic fluid powered motor 10 has the safety valve assembly 12 of the present invention integrated with the conventional reversing valve structure. The motor 10 includes a motor block 14 having an upper, planar face 16. The lower end of a cylindrical shell 18 is positioned in a shallow, circular recess 20 on the upper face 16 of the block 14. A cylinder head 22 having a lower planar face 24 is positioned above the cylindrical shell 18 and likewise has a shallow, circular recess 26 into which the upper end of the cylindrical shell 18 is fitted. Both the circular recesses 20 and 26 have a diameter substantially the same as the outer diameter of the cylindrical shell 18 so that a press fit is obtained between the ends of the shell 18 and the respective recesses in the block 14 and cylinder head 22. A conventional, plate type piston 30 is coaxially positioned within the cylindrical shell 18 for reciprocation through a stroke limited by the axial position of the recesses 20 and 26. A seal structure on the piston 30, including an inwardly extending peripheral groove on the piston and a suitable O-ring 32 partially recessed in the groove, forms a positive fluid seal between the periphery of the piston and the inside surface of the cylindrical shell 18. A piston rod 34 extends from the piston downwardly through a piston rod bore 36 in the block 14 that extends coaxially downwardly from the circular recess 20 in the block. The upper end of the piston rod 34 has an extension of reduced diameter with external threads that threadably engage an internally threaded coaxial bore in the piston 30. The piston rod 34 is tubular in construction and defines a coaxial channel 38, the purpose for which will be explained in greater detail below. Although not shown, the lower end of the piston rod 34 can be appropriately connected to a pump or other driven mechanism within the housing.

The cylinder head 22 serves the dual function of closing off the upper end of the cylindrical chamber 40 defined within the cylindrical shell 18 and of housing the safety reversing valve assembly 12 of the present invention. The valve assembly 12 is generally confined within a valve bore 42 opening coaxially onto the face of the cylindrical recess 26 in the cylinder head and extending upwardly therefrom. Pneumatic fluid, such as pressurized air from a suitable source, is supplied to the valve bore 42 through a channel 46 communicating between the lower portion of the valve bore 42 and the exterior of the cylinder head 22. A suitable fitting 48 is connected to a supply conduit 50 in turn coupled to the fluid source. The pneumatic fluid is exhausted to the atmosphere from the valve assembly through an exhaust channel 52 extending from the central portion of the valve bore 42 to the exterior of the cylinder head 22. Pneumatic fluid is supplied to and exhausted from the upper end of the cylindrical chamber 40 via a lower inlet and outlet channel 54 having one end terminating on the face of the cylindrical recess 26 in the cylinder head and having an inlet and outlet port 56 terminating on the central portion of the valve bore 42 at a location in the vertical dimension between the locations of the exhaust channel 52 and the supply channel 46. A second inlet and outlet channel 58 carries fluid to and from an inlet and outlet port 60 positioned in the valve bore 42 above the inlet and outlet port 56 and above the location of the exhaust channel 52. The second inlet and outlet channel 58 terminates in the lower face 24 of the cylinder head 22 at a location outside the cylindrical shell 18 and is coupled to a companion channel 62 in the motor block 14 by a transfer tube 66 and a fitting 64. The companion channel has a port opening onto the face of the cylindrical recess 20 to supply air to the lower portion of the cylindrical chamber 40.

The valve structure includes a valve sleeve 70 slidably fitted within the valve bore 42. The lower end of the sleeve 70 rests on the upper surface of a bushing 72 positioned adjacent the lower end of the valve bore 42 and retained in that position by a snap ring 74 located in an outwardly extending, annular groove at the bottom end of the valve bore 42. The bushing 72 has a peripheral annular groove in which an O-ring 76 is positioned to prevent fluid from escaping past the bushing directly into the cylindrical chamber 40. A cylindrical recess is provided in the bushing 72 that extends downwardly from the valve bore coaxially with the bore. The purpose of this recess will be explained in greater detail below. The valve sleeve 70 has a plurality of annular, inwardly extending grooves 78, 80, 82 and 84 that are positioned respectively at the axial locations of the inlet and outlet port 60 supplying the lower end of the cylindrical chamber 40, the location of the exhaust port 52, the location of the inlet and outlet port 56 supplying the upper end of the cylindrical chamber 40, and the supply channel 46. Each of the annular grooves 78, 80, 82 and 84 are placed in fluid communication with the sleeve bore 86 of the valve sleeve 70 by appropriately positioned, cruciform pairs of diametric bores.

The valve spool 90 is mounted for axial reciprocation within the sleeve bore 86. The spool has a hollow, central channel 92 extending between its lower and upper ends and a pair of exterior lands 94 and 96. An inwardly extending annular channel 98 is defined between the lands 94 and 96 and forms an annular cavity between the sleeve bore 86 and the spool 90. The lower portion 100 of the spool 90 that extends from the lower land 96 to the bottom end of the spool 90 has a reduced diameter. The reduced diameter portion 100 at the lower end of the spool is placed in fluid communication with the spool channel 92 by a cruciform pair of diametric bores. The upper end of the spool above the upper land 94 has a slightly reduced diameter relative to that of the lands 94 and 96. A relatively deep annular groove 102 is formed in the upper portion of the spool immediately adjacent the upper side of the upper land 94. This annular groove 102 communicates with the spool channel 92 through a cruciform pair of diametric bores. Two relatively shallow, concave, annular detent receiving grooves 104 and 106 are formed at axially space locations in the outer surface of the spool 90 above the upper annular groove 102.

A diametrically opposed pair of spherical detents 110 and 112 engage the detent grooves 104 and 106 to hold the spool in a first lowered position and a second, axially upwardly spaced intermediate position. The spherical detents, as well as trip springs 114 and 116 for biasing the spherical detents radially inwardly toward the valve spool 90, are housed within cylindrical, coaxial cavities on the inner ends of detent retaining bolts 118 and 120. Appropriate bosses 122 and 124, provided at the requisite locations on the cylinder head, have bores extending from the exterior of the cylinder head into the valve bore 42 to threadably receive the detent retaining bolts 118 and 120.

Figure 2:
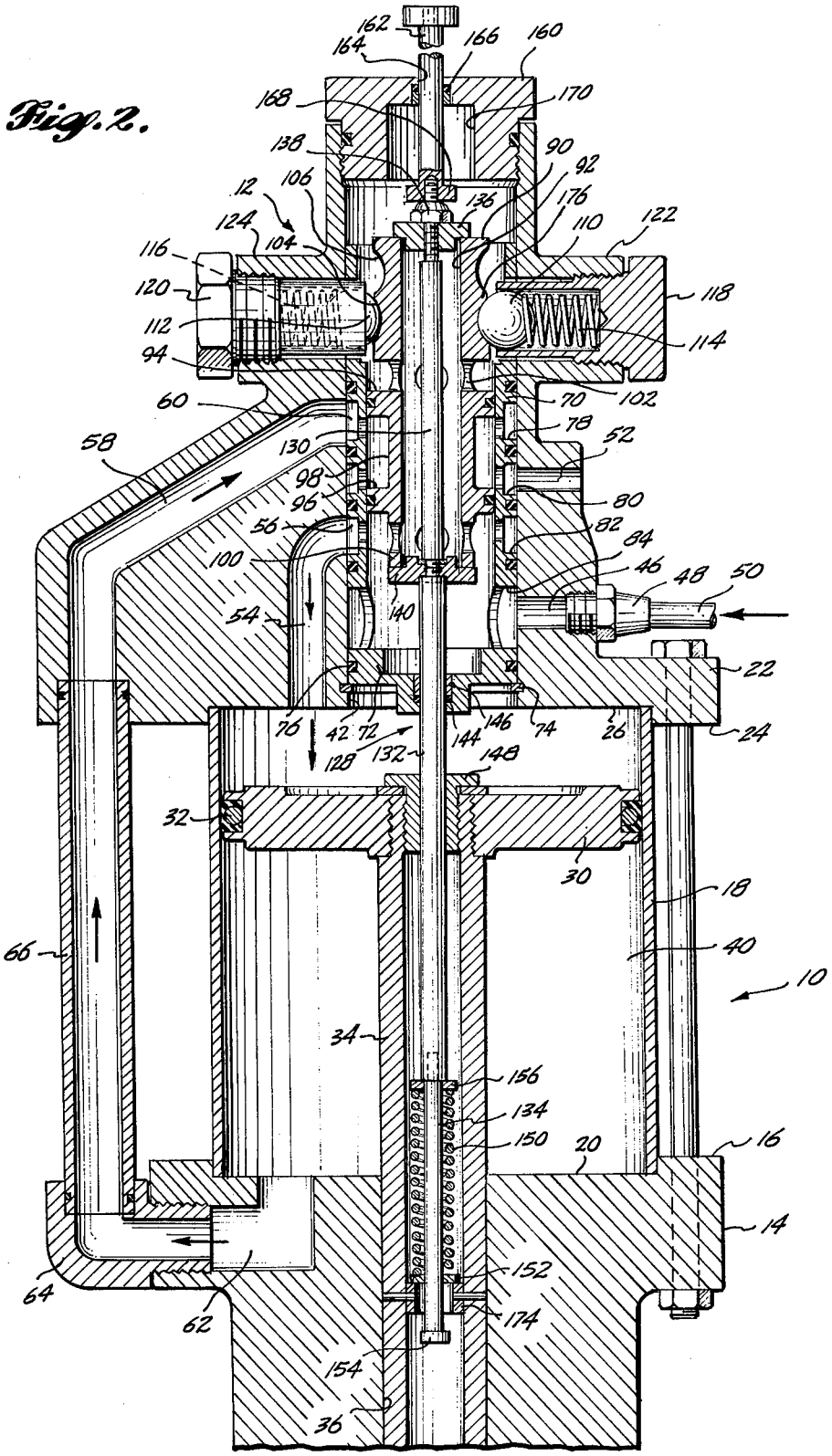
FIG. 2 is a view similar to FIG. 1 showing the reversing valve shifted to the second of its normal operating positions responsive to movement of the piston.

When the spherical detents 110 and 112 are engaging the upper detent groove 106, the valve spool 90 is first positioned within the sleeve 70 so that pneumatic fluid entering the valve bore 42 through the supply channel 46 will travel into the lower portion of the valve sleeve 70 through its lower cruciform bores, into the spool channel 92 through the lower cruciform bores in the spool 90, and outwardly through the cruciform bores communicating with the upper annular groove 102 above the upper land 94. Thence the fluid travels through the cruciform bores in the valve sleeve 70 communicating with the upper annular groove 80 in the sleeve, and through the upper outlet and inlet port 60, and hence to the lower portion of the cylindrical chamber 40 to force the piston 30 upwardly through a power stroke. At the same time, the fluid present in the upper portion of the cylindrical chamber 40 travels through the outlet and inlet channel 54, through the outlet and inlet bore 56 into one of the lower annular groove 82 in the valve sleeve, through the respective cruciform bores in the valve sleeve 70, into the annular channel 98 between the spool lands 94 and 96, and out the exhaust channel 52. When the valve spool is moved upwardly to its second position in which the spherical detents 110 and 112 engage the intermediate detent groove 104 in the spool as shown in FIG. 2, the flow direction of pneumatic fluid is reversed through the valve so that fluid is supplied to the upper portion of the cylindrical chamber 40 and exhausted from the lower portion of the cylindrical chamber 40.

Under normal operating conditions, the valve spool is reciprocated between its first and second positions by a valve tripping mechanism. A valve rod 128 forming part of the tripping mechanism has an upper portion 130, a central portion 132, and a lower portion or valve rod bolt 134. The upper portion 130 of the valve rod 128 extends coaxially through the spool channel 92 and is retained in fixed relationship thereto by an upper keeper 136 fastened to the valve rod by a suitable stub bolt and nut 138. The upper portion 130 of the valve rod is likewise affixed to the lower end of the valve spool 90 by a lower keeper 140. The lower keeper is fixed relative to the rod by a suitable key 142 positioned in a diametric slot in the upper end of the central portion 132 of the valve rod 128. The upper end of the central portion 132 of the valve rod reciprocates in a central bore in the valve sleeve retaining bushing 72. The upper portion of the valve bushing bore is slightly enlarged in diameter to receive an O-ring seal 144 that is fixed in place by a bushing insert 146 interference fitted with the enlarged diameter portion of the bushing bore. The lower end of the central portion 132 of the valve rod 128 extends through a central bore in a piston nut 148 threadably engaging the upper end of the central channel 38 in the piston rod 34.

The lower portion 134 of the valve rod 128, more correctly referred to as the valve rod bolt, has a threaded stub portion on its upper end which threadably engages an internally threaded bore in the lower end of the central portion 132 of the valve rod 128. A helically wound valve spring 150 is positioned about the valve rod bolt 134 and is retained thereon by upper and lower valve spring washers 156 and 152 that are slidably mounted on the valve rod bolt 134. The head 154 at the lower end of the valve rod bolt prevents the lower valve spring washer 152 from disengaging from the valve rod bolt. The upper valve spring retainer is prevented from moving upwardly beyond the upper end of the valve rod bolt as it abuts an annular shoulder on the bottom of the central portion 132 of the valve rod 128. The annular shoulder is created when the valve rod bolt 134, having a smaller diameter than the central portion 132 of the valve rod, is threaded into the lower end of the central portion 132 of the valve rod 128.

The upper end of the valve bore 42, opening upwardly through the top of the cylinder head 22, houses a valve reset mechanism. It is closed by a cylinder head cap 160 in the form of a large bolt having external threads on its lower end that threadably engage internal threads in the upper end of the valve bore 42. The cap 160 carries a reset plunger 162 slidably mounted in a central bore 164 in the cap 160 that is axially aligned with the cylinder bore 42. An O-ring 166 is suitably positioned at the lower end of the coaxial bore 164 to prevent pressurized air from escaping around the rest plunger 162. The reset plunger 162 has an enlarged plate-like bottom end 168 that is under certain conditions reciprocated into a cylindrical recess 170 extending upwardly from the bottom of the cap 160. A threaded bore extends coaxially upwardly into the bottom of the plunger 162. The upper threaded end of the stub bolt assembly 138 on the upper portion 130 of the valve rod 128 is threaded into the bore in the plunger, thereby interconnecting the two and providing a means for manual setting or resetting the valve spool position. The purpose for the valve reset mechanism will be better understood when called out again in conjunction with FIG. 3.

As previously explained, the valve spool 90 is shown in FIG. 1 in a position where pressurized air is supplied to the bottom of the cylindrical chamber 40 to cause the piston 30 to reciprocate in an upward power stroke. As the piston 30 and its associated pistion rod 34 nears the upward limit of its upward stroke, as depicted in FIG. 2, a valve trip collar 174 suitably keyed in the central channel 38 of the piston rod 34 passes the head 154 of the valve rod bolt 134 and engages the lower valve spring washer 152. As the upward movement of the piston and rod continues, the upper valve spring retainer and the coil spring are moved upwardly on the valve rod bolt 134 until the upper retainer 156 abuts the shoulder on the bottom of the central portion 132 of the valve rod. Thereafter, the coil spring 150 is compressed by the coaction of the valve trip collar 174 on the lower valve spring washer 152. The spring rate of the valve spring 150 is chosen such that the upward force it exerts on the valve rod 128 when the piston 30 reaches to top of its upward stroke will exceed the radially inward biasing force of the trip springs 114 and 116 on the spherical detents 110 and 112, causing the valve spool 90 to move upwardly. As it moves upwardly, the spherical detents 110 and 112 disengage from the upper detent groove 106, slide across the shoulder 176 between the upper and lower detent grooves 106 and 104 and reengage with the lower detent groove 104. As this occurs, the lands 94 and 96 on the valve spool 90 are repositioned relative to the ports in the valve sleeve 70 so that the flow of pneumatic fluid supplied through channel 46 is reversed in the cylindrical chamber 40 to drive the piston 30 in a downward power stroke. In other words, the pneumatic fluid flowing into the valve bore from the supply channel 46 passes through the cruciform bores in the lower end of the valve sleeve 70 and passes upwardly into the annular cavity formed by the reduced diameter portion 100 on the bottom of the valve spool 90 below the lower lands 96, through the lower inlet and outlet port 56 and into the inlet and outlet channel 54 communicating with the upper end of the cylindrical chamber 40. Likewise, air present in the lower portion of the cylindrical chamber 40 passes out through the inlet and outlet channel 62 upwardly through the transfer tube 66 into the upper inlet and outlet channel 58 in the cylinder head, through the inlet and outlet port 60, into the annular channel 98 between the upper and lower lands 94 and 96 and out through the exhaust channel 52.

As the piston nears the bottom of its downward power stroke, the bottom annular surface of the piston nut 148 engages the upper valve spring retainer 156. Again, the valve spring 150 is compressed to the point where the force exerted by the valve spring 150 on the valve rod 128 causes the valve spool 90 to again shift to its normal lower position wherein the spherical retainers 110 and 112 disengage from the lower detent bore 104 and reengage with the upper detent bore 106, again reversing the flow of pressurized air to the cylindrical chamber 40 to reinitiate the piston reciprocation cycle.

Figure 3:
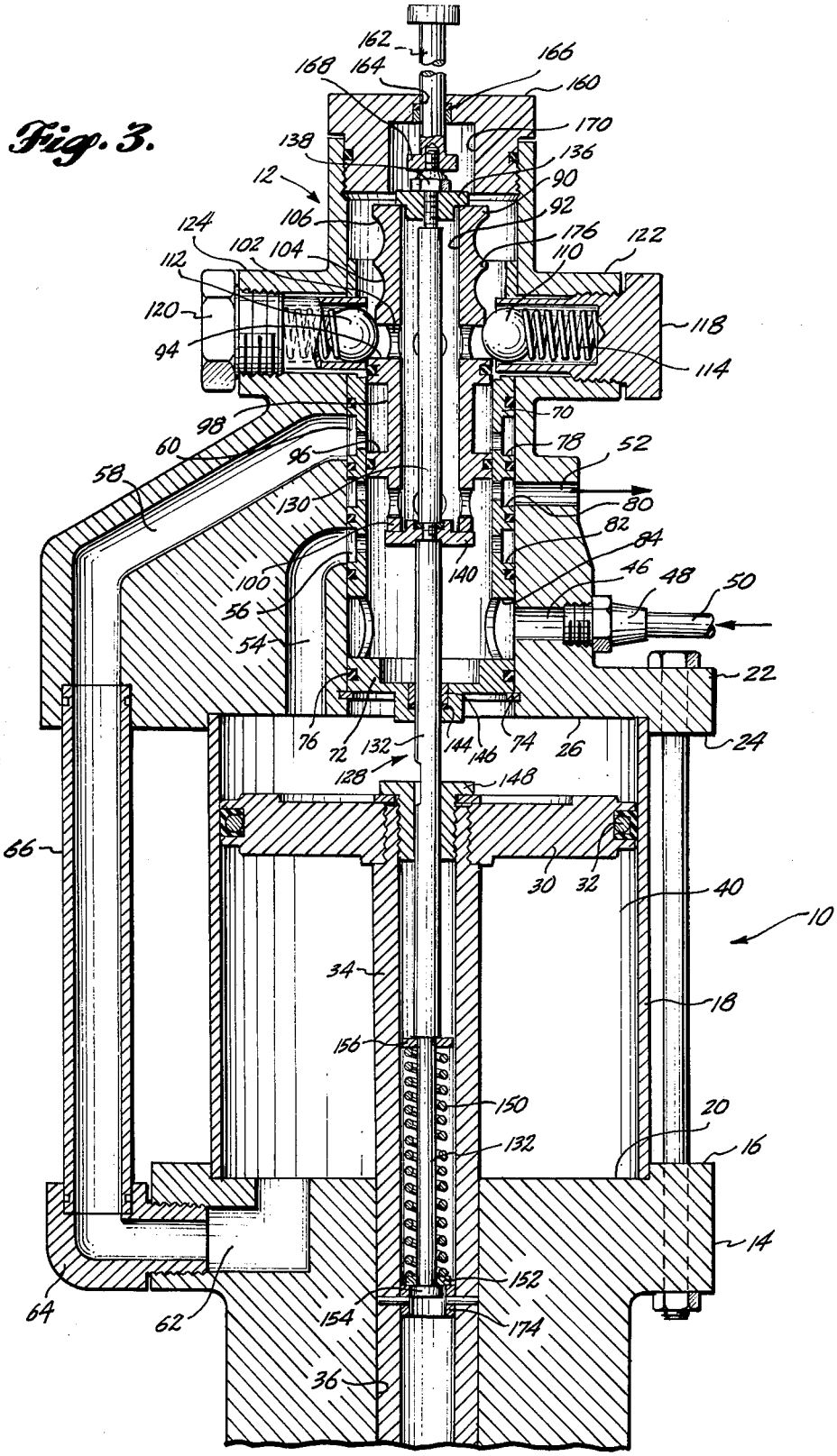
FIG. 3 is a view similar to FIGS. 1 and 2 showing the safety valve of the present invention in its third position wherein the valve short circuits the fluid supply to the piston when an excessive piston reciprocation rate has occurred.

The positioning of the valve spool 90 as shown in FIGS. 1 and 2 is that which occurs under normal operating conditions, i.e., those conditions wherein the pump or other apparatus being operatively driven by the piston rod 34 is under a load. When the load is accidentally relieved from the pump or other apparatus coupled to the piston rod 34, the piston 30 will begin to reciprocate at an increasing rate, limited by the internal friction in the air motor and associated pump. As this occurs, the valve spool 90 will shift to the position shown in FIG. 3. As illustrated in FIG. 3, the valve spool 90 has been shifted upwardly so that the spherical detents 110 and 112 no longer engage either of the upper and lower detent grooves 104 and 106, but instead lock the valve spool in a position above its two normal positions where the spherical detents 110 and 112 are seated in the annular groove 102 immediately above the upper land 94. In this position, the pneumatic fluid entering the valve bore 42 through supply channel 46 enters the valve sleeve bore and travels upwardly around the reduced diameter portion 100 on valve spool 90 and directly out the exhaust channel 52, thus short circuiting the air supply to the cylindrical chamber 40. Although the inlet and outlet channel 54 is in communication with the pressurized air supply, the piston 30 cannot move downwardly as the air in the cylindrical chamber 40 below the piston 30 cannot be exhausted because the valve spool 90 is blocking the upper inlet and outlet port 60. Thus the power cycle of the piston 30 is effectively terminated when the valve spool 90 is in its upper short circuiting position.

The valve spool 90 is caused to move into its upper short circuiting position in a manner similar to that in which it is caused to shift from its first lower position wherein the spherical detents 110 and 112 are engaging the upper detent groove 106 to its second position wherein the spherical detents 110 and 112 are engaging the lower detent groove 104. However, when the piston 30 is reciprocating at a high rate, the energy transferred to the valve rod 128 through the valve spring 150 is significantly greater than under normal operation. That is, as the valve trip collar 174 engages the lower valve spring washer 152 as the piston 30 rises on its upward power stroke, the valve spring 150 is compressed to a greater extent than under normal operation. The greater energy stored in the valve spring 150 will cause the valve to begin to shift from its position as shown in FIG. 1 toward its position as shown in FIG. 2. However, because of the higher energy stored in the spring 150, the valve spool 90 will be traveling at a greater than normal velocity during this initial shift. The shoulder 180 formed on the periphery of the spool 90 between the lower detent groove 106 and the annular groove 102 immediately above the upper land 94 is machined to a diameter that will allow the spherical detents 110 and 112 to disengage from the lower detent groove 106 when the valve is traveling at high velocities. Thus the valve spool 90 when traveling at greater than normal velocity will continue its travel until the detents 110 and 112 engage the annular groove 102.

When the pump or other equipment operatively coupled to the piston rod 34 is again primed or otherwise placed under a load, the valve spool 90 can be repositioned so that the spherical detents 110 and 112 will again engage the lower detent groove 106. This is accomplished by manually exerting a downward force on the reset plunger 162. As the plunger 162 is pushed downwardly, the valve spool is moved downwardly, causing the spherical detents 110 and 112 to disengage from the annular groove 102 and reengage with the lower detent groove 106. Thereafter, pneumatic fluid can be readmitted to the valve bore 42 through the supply channel 46 to again initiate operation of the motor.

Figure 4:
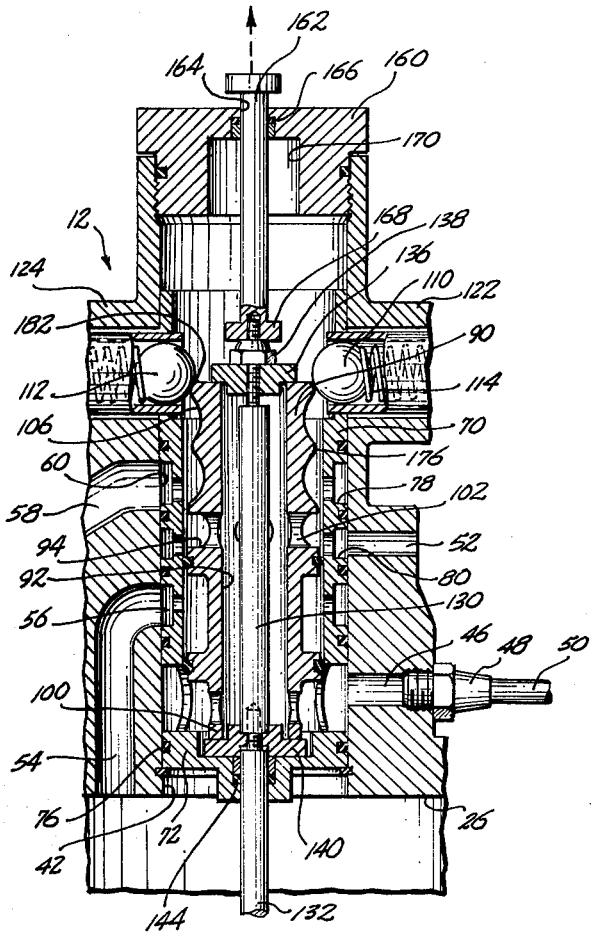
FIG. 4 is a view similar to FIGS. 1 and 2 showing the valve of the present invention in a fourth position wherein the valve short circuits the fluid supply to the piston.

Depending upon how the pump or other apparatus coupled to the piston rod 34 is constructed and operated, the upward stroke of the piston 30 may not have sufficient energy to reposition the valve in the upper short circuiting position. Consequently, the valve of the present invention is constructed so that it can override the upper detent groove 106 and be moved to a lower short circuiting position responsive to an accelerated downward stroke of the piston 30. As illustrated in FIG. 4, the valve spool 90 has been shifted downwardly so that the spherical detents 110 and 112 no longer engage either of the upper and lower detent grooves 104 and 106, but instead have overriden the upper annular ridge 182 between the grooves 104 and 106 and the upper end of the valve spool 90. In the lower short circuiting position the spherical detents 110 and 112 engage the end of the spool on the side of the upper annular ridge 182 opposite from the detent grooves 104 and 106. The upper annular ridge 182 has an outside radius slightly greater than the radius of the ridge between the detent grooves 104 and 106 so that under normal operating circumstances, the valve spool 90 will not override to its lower short circuiting position. The spherical recess in the bushing 140 mentioned above receives the lower end of the valve spool assembly when it is in its lower short circuiting position, thus allowing the spool to travel downwardly sufficiently far to rearrange the lands on the spool so that fluid is exhausted through the exhaust channel 52.

When the spool 90 is in the lower short circuiting position, the pneumatic fluid entering the valve bore 42 through the supply channel 46 enters the valve sleeve bore and the valve spool bore 92 and travels upwardly through the valve spool bore and out the ports 102 communicating with the annular groove 94 in the valve spool. Hence the pressurized air is exhausted through the exhaust channel 52, short circuiting the air supplied to the cylindrical chamber 40. Thus the power cycle of the piston 30 is also effectively terminated when the valve spool 90 is in its lower short circuiting position.

When the pump or other apparatus operatively coupled to the piston rod 34 is again primed or otherwise placed under a load, the valve spool 90 can be repositioned by manually exerting an upward force on the reset plunger 162 thereby re-engaging the spherical detents 110 and 112 with the upper detent groove 104. Thereafter, pneumatic fluid can be re-admitted to the bore 42 through the supply channel 46 to again initiate operation of the motor.

Although the present invention has been described in relation to a preferred embodiment, one of ordinary skill after reading the foregoing specification, will be able to effect various changes, substitutions of equivalents and other variations without departing from the intended scope of the invention. For example, after reading the foregoing specification, other detent mechanisms that normally holds a valve spool or other valve member in its normal reversing positions, can easily be altered to effect movement of the valve member to a third short circuiting position. It is therefore intended that the scope of letters patent granted hereon be limited only by the definition contained in the appended claims and equivalents thereof.

What is claimed is:

1. In a piston type fluid powered motor including means defining a cylinder bore, a piston reciprocally mounted in said cylinder bore, a valve body defining a valve bore, a valve spool mounted in said valve bore, said valve bore and said valve body having cooperating lands and ports for supplying fluid to one side of said piston through a supply channel when said valve spool is in a first position, and for exhausting fluid from said one side of said piston when said valve spool is in a second position, an improved mechanism for stopping the reciprocation of said piston responsive to a predetermined high rate of reciprocation of said piston, comprising:

actuating means associated with said valve spool and said piston (a) for reversibly shifting said valve spool between said first and second positions responsive to reciprocation of said piston in said cylinder bore at a rate less than a predetermined high rate of reciprocation, and (b) for moving said valve to at least a third position responsive to said predetermined high rate of reciprocation of said piston, said valve spool and said valve body having cooperating lands and ports for short circuiting the fluid supply to said cylinder bore and exhausting fluid normally supplied to said cylinder bore when said valve spool is in said third position, and detent means associated with said valve body and said valve spool for normally holding said valve spool in said first and second positions and for holding said valve spool in said third position when shifted to said third position by said actuating means.

2. In the apparatus of claim 1 wherein said detent means cooperate with said actuating means to prevent said valve spool from shifting to said third position until said piston reciprocates at said predetermined high rate.

3. In the apparatus of claim 1 wherein said valve spool has a first, annular, inwardly extending groove in the outer surface thereof and a second, annular, inwardly extending groove in the outer surface of said spool positioned adjacent said first annular groove, said first and second annular grooves being separated by an annular ridge having a predetermined radius relative to said spool, and wherein said detent means comprises a detent member and means mounting said detent member on said valve body for movement into and out of said first and second annular grooves as said spool moves respectively between said first and second positions, and wherein said valve spool has an annular, inwardly extending, reduced diameter portion in the outer surface thereof, said reduced diameter portion being positioned adjacent said first and second annular grooves, said detent member further cooperating with said reduced diameter portion to hold said valve body in said third position, and means associated with said detent member for urging said detent member toward said spool and into retentive engagement with said first and second annular grooves and with said reduced diameter portion.

4. In the apparatus of claim 3 wherein said reduced diameter portion is separated from said first and second annular grooves by an annular ridge having a predetermined outer radius greater than the radius of said ridge separating said first and second annular grooves.

5. In the apparatus of claim 4 wherein said reduced diameter portion comprises a third annular groove in said valve spool.

6. In the apparatus of claim 1 further comprising:

means for manually repositioning said valve spool from said third position to one of said first and second positions.

7. In the apparatus of claim 3 wherein said reduced diameter portion of said spool is adjacent one side of said first and second annular grooves, said valve spool having a third annular, inwardly extending groove in the outer surface thereof positioned on the opposite side of said first and second grooves from said reduced diameter portion, said actuating means further for moving said valve to a fourth position responsive to said high rate or reciprocation of said piston, said valve spool and said valve body having cooperating lands and ports for short circuiting the fluid supply to said cylinder bore and exhausting fluid normally supplied to said cylinder bore when said valve spool is in said fourth position, said detent member further cooperating with said third annular groove to hold said valve body in said fourth position.

8. In the apparatus of claim 3, said reduced diameter portion being one end of said spool, said end of said spool and said first and second annular grooves being separated by an annular ridge on said spool having a predetermined outer radius greater than the radius of said ridge separating said first and second annular grooves.

9. A fluid flow reversing valve assembly comprising body means defining a valve bore having a first end, a second end and a central portion, a first outlet and inlet port communicating with said bore, a second outlet and inlet port communicating with said bore, said first and second outlet and inlet ports being positioned at axially spaced locations along the central portion of said bore, a supply port for supplying fluid to said bore and an exhaust port for exhausting fluid from said bore, one of said exhaust port and said supply port being positioned adjacent the first end of said bore and the other of said exhaust port and said supply port being positioned at a location between said first and second outlet and inlet ports, a valve spool having first and second ends respectively associated for movement adjacent said first and second ends of said valve bore, said spool having at least first and second lands thereon, said first and second lands being respectively positioned on said spool adjacent said first and second ends thereof, said spool having a first annularly shaped groove between said first and second lands and a second annularly shaped groove between said second land and said second end of said spool, said spool having a channel therethrough for placing the first end of said valve bore in fluid communication through said spool with said second groove, said valve spool being reciprocally mounted in said valve bore for movement between first, second and third axially spaced positions, said lands, said grooves and the channel in said spool cooperating with said ports in said bore (a) when said spool is in said first position to place said supply port in fluid communication through said channel with said first outlet and inlet port and to place said exhaust port in fluid communication through said second annular groove with said second outlet and inlet port, (b) when said spool is in said second position to place said supply port in fluid communication with said second outlet and inlet port and to place said first outlet and inlet port in fluid communication through said first annular groove with said exhaust port, and (c) when said spool is in said third position to place said supply port in fluid communication with said exhaust port, and detent means associated with said valve body and with said valve spool for releasably holding said valve in said first, second and third positions.

10. The reversing valve assembly of claim 9 wherein said spool is axially displaced in a predetermined direction from said first position when said spool is moved to said second position from said first position, and is axially displacd in the same direction when said spool is moved from said second position to said third position.

11. The reversing valve assembly of claim 9 wherein said spool has third and fourth annular radially inwardly extending grooves therein, said third and fourth grooves being positioned between said second groove and the second end of said spool, said third and fourth grooves being separated from the second end of said spool by an annular ridge, and wherein said detent means comprises a spherically shaped member mounted in said valve body for reciprocation in a generally radial direction relative to said spool, said spherically shaped member being sized to seat in said third and fourth grooves to hold said spool in said first and second positions, respectively, and being sized to rest on the opposite side of said annular ridge from said first and second grooves to hold said spool in said third position.

12. The reversing valve assembly of claim 9 wherein said spool has third and fourth annular, radially inwardly extending grooves therein, said third and fourth grooves being positioned between said second groove and the second end of said spool, and wherein said detent means comprises a spherically shaped member mounted in said valve body for reciprocation in a generally radial direction relative to said spool, said spherically shaped member being sized to seat in said second, third, and fourth grooves to hold said spool respectively in said third, first and second positions, and wherein said reversing valve assembly further comprises means for biasing said spherically shaped member in a radially inward direction.

* * * * *

UNITED STATES PATENT AND TRADEMARK OFFICE

CERTIFICATE OF CORRECTION

PATENT NO. : 4,079,660

DATED : March 21, 1978

INVENTOR(S) : Frank E. Ives

It is certified that error appears in the above-identified patent and that said Letters Patent are hereby corrected as shown below:

Column 2, line 38: "reponsive" is changed to --responsive --.

Column 6, line 48: "rest" is changed to —reset—.

Signed and Sealed this

*First* Day of *August 1978*

[SEAL]

*Attest:*

RUTH C. MASON
*Attesting Officer*

DONALD W. BANNER
*Commissioner of Patents and Trademarks*